US006575243B2

(12) United States Patent
Pabst

(10) Patent No.: US 6,575,243 B2
(45) Date of Patent: Jun. 10, 2003

(54) ZONAL ISOLATION TOOL WITH SAME TRIP PRESSURE TEST

(75) Inventor: James E. Pabst, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 108 days.

(21) Appl. No.: 09/835,690

(22) Filed: Apr. 16, 2001

(65) Prior Publication Data

US 2002/0148607 A1 Oct. 17, 2002

(51) Int. Cl.[7] ..... E21B 47/00
(52) U.S. Cl. ..... 166/250.08; 166/278; 166/51
(58) Field of Search ..... 166/250.01, 250.08, 166/278, 66, 51

(56) References Cited

U.S. PATENT DOCUMENTS

| | | | | |
|---|---|---|---|---|
| 3,071,193 A | | 1/1963 | Raulins | 166/226 |
| 4,100,969 A | | 7/1978 | Randermann, Jr. | 166/324 |
| 4,794,989 A | | 1/1989 | Mills | 166/387 |
| 5,148,870 A | * | 9/1992 | Fernandez et al. | 166/344 |
| 5,156,220 A | | 10/1992 | Forehand et al. | 166/386 |
| 5,316,084 A | | 5/1994 | Murray et al. | 166/332 |
| 5,343,949 A | | 9/1994 | Ross et al. | 166/278 |
| 5,579,844 A | | 12/1996 | Rebardi et al. | 166/296 |
| 5,609,204 A | * | 3/1997 | Rebardi et al. | 166/227 |
| 5,655,607 A | | 8/1997 | Mellemstrand et al. | 166/386 |
| 5,865,251 A | | 2/1999 | Rebardi et al. | 166/278 |
| 5,988,285 A | | 11/1999 | Tucker et al. | 166/373 |
| 5,996,696 A | | 12/1999 | Jeffree et al. | 166/386 |

* cited by examiner

*Primary Examiner*—David Bagnell
*Assistant Examiner*—Jennifer R. Dougherty
(74) *Attorney, Agent, or Firm*—Williams, Morgan & Amerson, P.C.; Jeffrey Griffin; Brigitte Jeffery

(57) ABSTRACT

Apparatus and methods for gravel packing, isolating and testing a sand screen completion of a wellbore in a single trip are disclosed. One method comprises inserting into the wellbore a sand screen assembly, an isolation pipe, and a test assembly on a workstring. A gravel pack operation is performed, and the isolation pipe is shifted to a position in sealing contact with the sand screen assembly, thereby isolating the sand screen assembly. The test assembly is then shifted to a configuration that provides hydraulic communication between the interior of the isolation pipe and the workstring-wellbore annulus above the test assembly. Imposing pressure on the workstring-wellbore annulus then hydraulically tests the integrity of the seal between the isolation pipe and the sand screen assembly.

46 Claims, 10 Drawing Sheets

ZONAL ISOLATION TOOL WITH SAME TRIP PRESSURE TEST

BACKGROUND OF THE INVENTION

1. Field of the Invention

This invention relates generally to tools used to complete subterranean wells. More particularly the present invention describes a means of pressure testing the effectiveness of a zonal isolation system after installation.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well. One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is pumped in a slurry down the tubing and through the cross-over, thereby flowing into the annulus between the screen and the wellbore. The liquid forming the slurry leaks off into the formation and/or through the screen, which is sized to prevent the gravel in the slurry from flowing through. The liquid that passes through the screen flows up the tubing and then the cross-over directs it into the annulus area above the packer where it can be circulated out of the well. As a result of this operation, the gravel is deposited in the annulus area around the screen where it forms a gravel pack. The screen prevents the gravel pack from entering into the production tubing. It is important to size the gravel for proper containment of the formation sand, and the screen must be designed in a manner to prevent the flow of the gravel through the screen.

At times it is desirable to complete a zone and then isolate the zone until production is initiated at a later date. One example of when delayed production might be beneficial is when multiple productive zones having significantly different formation pressures are to be completed in a single well. If a first zone having greater formation pressures is completed with a second zone that has lower pressures, hydrocarbons from the first zone will migrate to the second zone and may decrease the ultimate recovery that is obtained from the first zone. To maximize the ultimate recovery from the well, it may be beneficial to initially produce only the first zone with the higher pressure. Once the formation pressure of the first zone has decreased to where it is close to the formation pressure of the second zone, the second zone can be produced along with the first zone, and the commingled zones can be depleted together without any loss of reserves from interzonal migration. Economically it would be beneficial to complete both zones while the drilling/completion equipment is on the well, but isolate the second zone until production is desired at a later date.

Zonal isolation systems are used to isolate and selectively produce oil or gas from separate zones in a single well. U.S. Pat. Nos. 5,579,844; 5,609,204 and 5,988,285 describe systems for the zonal isolation of wells. The high variability in downhole conditions and well tool configurations create a need for testing the integrity of zonal isolation systems after their installation. If a zone is not adequately isolated, substantial quantities of hydrocarbon reserves can be lost, resulting in significant economic losses. One method of testing the integrity of zonal isolation system is by running in the well with one or more packer assemblies on a workstring. The packers are set to isolate individual segments of the isolation system, which can then be tested for any leakage. This method requires additional trips in and out of the wellbore that results in increased expense. Any reduction in the number of trips required to complete a well will result in significant cost savings.

There is a need for improved tools and methods to test the integrity of zonal isolation systems after their installation.

SUMMARY OF THE INVENTION

One embodiment of the present invention is a zone isolation apparatus for use in completing a wellbore comprising a sand screen assembly and a tubular string disposed within the wellbore. Also included is an isolation assembly that is movable within the sand screen assembly and capable of being selectively positioned in an open configuration and a closed configuration, and a test assembly attached to the tubular string and capable of being selectively positioned in an open configuration and a closed configuration. When the isolation assembly is in its closed configuration fluid communication through the sand screen assembly is restricted, and when the test assembly is in its open configuration, hydraulic communication of the isolation assembly with the surface is achieved. The test assembly can be retained in the closed configuration by a releasable retaining element and can further comprise a sliding sleeve having at least one aperture and a stationary sleeve having at least one aperture. When the test assembly is in its open configuration the apertures of the sliding sleeve are aligned with the apertures of the stationary sleeve and fluid communication is provided through the aligned apertures. The sand screen assembly may also comprise a packer element.

The tubular member placed within the wellbore defines an annulus area. When the isolation assembly is in its closed configuration and the test assembly is in its open configuration, hydraulic communication between the annulus area above the packer and the interior of the isolation assembly can be achieved while also providing hydraulic isolation from the annulus area below the packer. The isolation assembly can comprise an isolation pipe and at least one seal element. When the isolation assembly is in its closed configuration, the isolation pipe forms a seal within the sand screen assembly and fluid communication through the sand screen assembly is restricted. The isolation assembly may comprise a shifting collet assembly attached to the tubular member that is capable of engaging with the isolation pipe. The shifting collet may include flex beam portions that are capable of engaging with the isolation pipe. The isolation assembly can also have a latching collet assembly that engages with the sand screen assembly when the isolation assembly is in its closed configuration.

The test assembly can comprise a test port and at least one seal assembly, where the test port and the seal assemblies are capable of aligning with the packer and the sand screen assembly to provide hydraulic communication of the interior of the isolation assembly with the annulus above the packer and hydraulic isolation from the annulus below the packer.

Another embodiment of the invention is a tool for isolating and testing a sand screen assembly within a wellbore comprising a tubing string disposed within the wellbore and forming a tubing-wellbore annulus, an isolation pipe assembly movable within the sand screen assembly and capable of being selectively positioned in an upper position and a lower position, and an isolation test tool attached to the tubing string and capable of being selectively positioned in an open configuration and a closed configuration. When the isolation pipe assembly is in its lower position, fluid communication through the sand screen assembly is restricted and when the isolation test tool is in its open configuration, hydraulic isolation between the isolation pipe assembly and the tubing-wellbore annulus is achieved.

The sand screen assembly may further comprise a packer element, and the isolation test tool may comprise a sliding sleeve having at least one test port. The isolation pipe assembly may be retained in its upper position by a releasable retaining element. The isolation pipe assembly can be shifted from its upper position to its lower position by means of a shifting collet connection with the tubing string. The isolation test tool may be held in its closed configuration by a retaining element.

Yet another embodiment of the invention is a method for isolating and testing a sand screen assembly in a wellbore from passage of fluids through it. The method comprises positioning an isolation pipe assembly within the sand screen assembly, positioning an isolation test tool attached to a tubing string within the wellbore, and shifting the isolation pipe assembly into a sealed position where the isolation pipe assembly is in sealing contact with the sand screen assembly, thereby restricting fluid flow through the sand screen assembly. The method further comprises shifting the isolation test tool to a testing configuration, and testing the integrity of the seal between the isolation pipe assembly and the sand screen assembly.

The isolation pipe assembly may comprise a sliding sleeve mechanism that is in sliding contact with the sand screen assembly. The shifting of the isolation pipe assembly can also utilize a shifting collet connected to the tubular string, and can include the imposition of a downward force on the tubular string that is transferred through the shifting collet connection onto the isolation pipe assembly. Once the isolation pipe assembly is shifted into its sealed position, the isolation pipe assembly can be retained in its sealed position by means of a retaining collet. The shifting of the isolation test tool may likewise include a further downward force on the tubular string that is transferred onto the isolation pipe assembly. The isolation pipe assembly and the isolation test tool may be held in their initial position by retaining elements, such as shear elements. The shifting of the isolation test tool to a testing configuration comprises aligning testing ports to an open position to create hydraulic communication between the isolation pipe assembly and an annulus region in the wellbore and can also comprise aligning at least one seal that isolates a cross-over port located within the sand screen assembly from hydraulic communication with the interior of the isolation pipe assembly. The testing of the integrity of the seal between the isolation pipe assembly and the sand screen assembly can include pressure testing of an annulus region in the wellbore that is in hydraulic communication with the interior of the isolation pipe assembly.

Still another embodiment is an isolated production pipe assembly formed according to a method comprising providing a non-isolated production pipe assembly in a wellbore, the non-isolated production pipe having a sand control screen, attaching a shifting collet housing assembly to an isolation pipe string assembly, and inserting the shifting collet housing assembly and isolation pipe string assembly into the non-isolated production pipe assembly. The method further comprises attaching a testing tool capable of being in a first configuration and a second configuration, a shifting collet assembly and a tubular string to form a work string. The work string is then inserting into the wellbore, thereby defining a work string-wellbore annulus, so that the shifting collet assembly engages the interior of the shifting collet housing assembly. A downward force is imparted on the work string to move the isolation pipe string assembly into a position where the isolation pipe string assembly is in sealing contact with the non-isolated production pipe assembly both above and below the sand control production screen. This converts the non-isolated production pipe assembly into an isolated production pipe assembly, wherein the isolated production pipe assembly in the wellbore prevents fluid flow through the sand control screen. A further downward force is applied on the work string to shift the testing tool from its first position to its second position, so that the testing tool provides hydraulic communication between the interior of the isolated production pipe assembly and the work string-wellbore annulus above the testing tool. The work string-wellbore annulus is then pressure tested to test the integrity of the isolated production pipe assembly.

The isolation pipe string assembly is retained in sealing contact with the non-isolated production pipe by means of a retaining collet device. The testing tool is capable of being held in its first position by means of a retaining element, such as a shear element that will break when a predetermined force is applied against it.

In yet another embodiment a method of gravel packing, isolating and testing a sand screen completion of a wellbore in a single trip is disclosed. This method comprises inserting into the wellbore a sand screen assembly, an isolation pipe, and a test assembly on a workstring, performing a gravel pack operation, and shifting the isolation pipe to a position in sealing contact with the sand screen assembly, thereby isolating the sand screen assembly. The test assembly is then shifted to a configuration that provides hydraulic communication between the interior of the isolation pipe and the workstring-wellbore annulus above the test assembly. The integrity of the seal between the isolation pipe and the sand screen assembly is then hydraulically tested by imposing pressure on the workstring-wellbore annulus at the surface.

The sand screen assembly can include a packer located above the sand screen. During the gravel pack operation carrier fluid returns are able to circulate to the surface through the sand screen, isolation pipe, test assembly, and workstring. The test assembly can comprise a test port and at least one seal assembly. When the workstring is used to shift the test assembly, the test port and the seal assemblies align with the packer and the sand screen assembly to provide hydraulic communication between the isolation pipe and the workstring-wellbore annulus above the packer while providing hydraulic isolation from the sand screen-wellbore annulus below the packer.

A particular embodiment involves a method of completing a well comprising isolating a sand screen assembly with isolation tubing, and testing the hydraulic seal of the isolated sand screen assembly through a test assembly.

The method may further comprise inserting a sand screen assembly, isolation tubing and a test assembly into the well on a workstring, shifting the isolation tubing into a sealed position within the sand screen assembly, shifting the test assembly into an open position, and pressure testing the workstring-well annulus to test the hydraulic seal of the isolation tubing within the sand screen assembly. A gravel pack operation may be performed and the well flow tested prior to isolating the sand screen assembly.

DESCRIPTION OF ILLUSTRATIVE EMBODIMENTS

Figure 1:
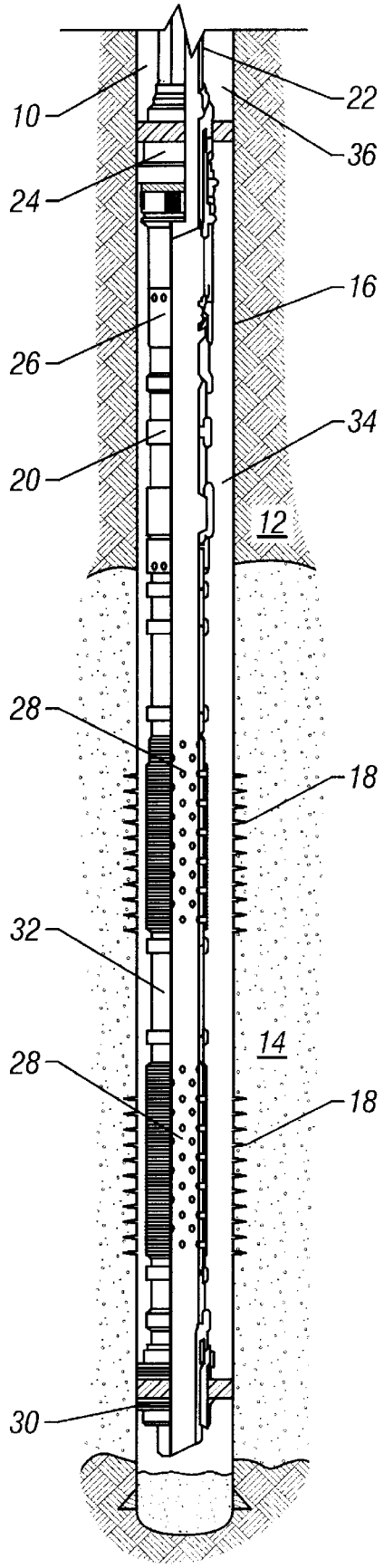
FIG. 1 (Prior Art)
FIG. 1 is a cross section of a wellbore showing a typical gravel pack completion apparatus. This illustration is of prior art.

Referring to the attached drawings, FIG. 1 illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent to the productive formation 14, which is to be gravel packed.

The present invention can be utilized in both cased wells and open hole completions. For ease of illustration of the relative positions of the producing zones in FIGS. 1–3, a cased well having perforations will be shown.

The well tool 20 comprises a tubular member 22 attached to a production packer 24, a cross-over 26, and one or more screen elements 28. The tubular member 22 can also be referred to as a tubing string, coiled tubing, workstring or other terms well known in the art. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string. FIG. 1 shows an optional lower packer 30 located below the perforations 18.

In a gravel pack operation the packer element 24 is set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack.

As used herein, the term "screen" includes wire wrapped screens, mechanical type screens and other filtering mechanisms typically employed with sand screens. Sand screens need to be have openings small enough to restrict gravel flow, often having gaps in the 60–120 mesh range, but other sizes may be used. The screen element 28 can be referred to as a sand screen. Screens of various types are produced by US Filter/Johnson Screen, among others, and are commonly known to those skilled in the art.

Figure 2:
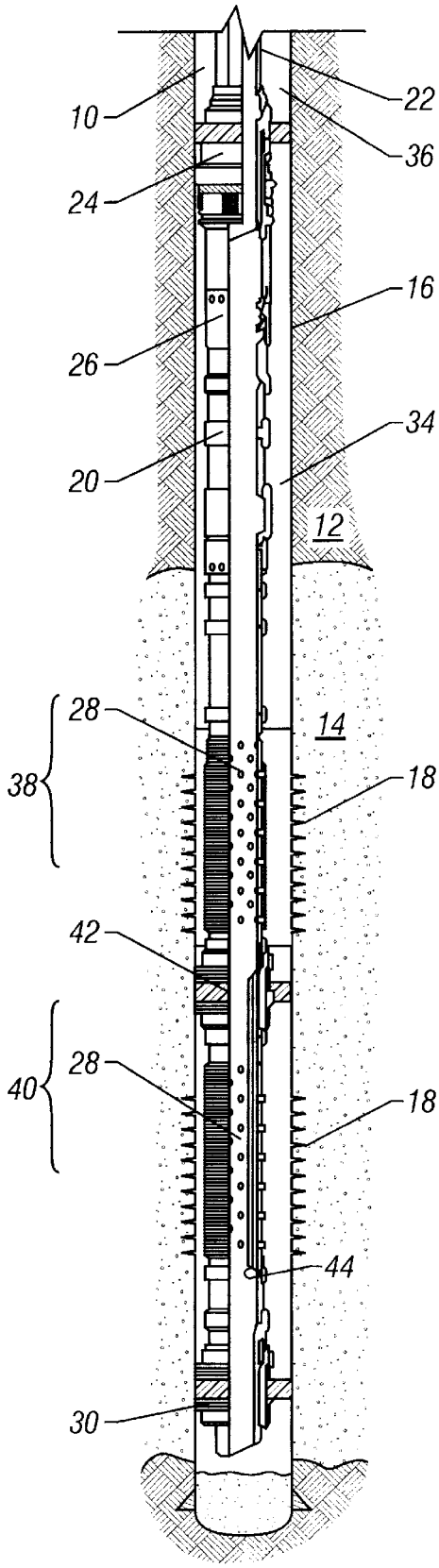
FIG. 2 (Prior Art)
FIG. 2 illustrates an application of the present invention whereby a lower zone is isolated.

FIG. 2 illustrates an application of the present invention where an upper zone 38 and a lower zone 40 are each perforated and gravel packed. An isolation packer 42 is set between them. An isolation assembly 44 is set within the lower screen element and isolates the lower zone 40 from the upper zone 38 and the tubular member 22. This configuration will enable the production from the upper zone 38, while the lower zone 40 remains isolated. The isolation assembly 44 is shown in greater detail in FIGS. 4–11 and is described in detail below.

Figure 3:
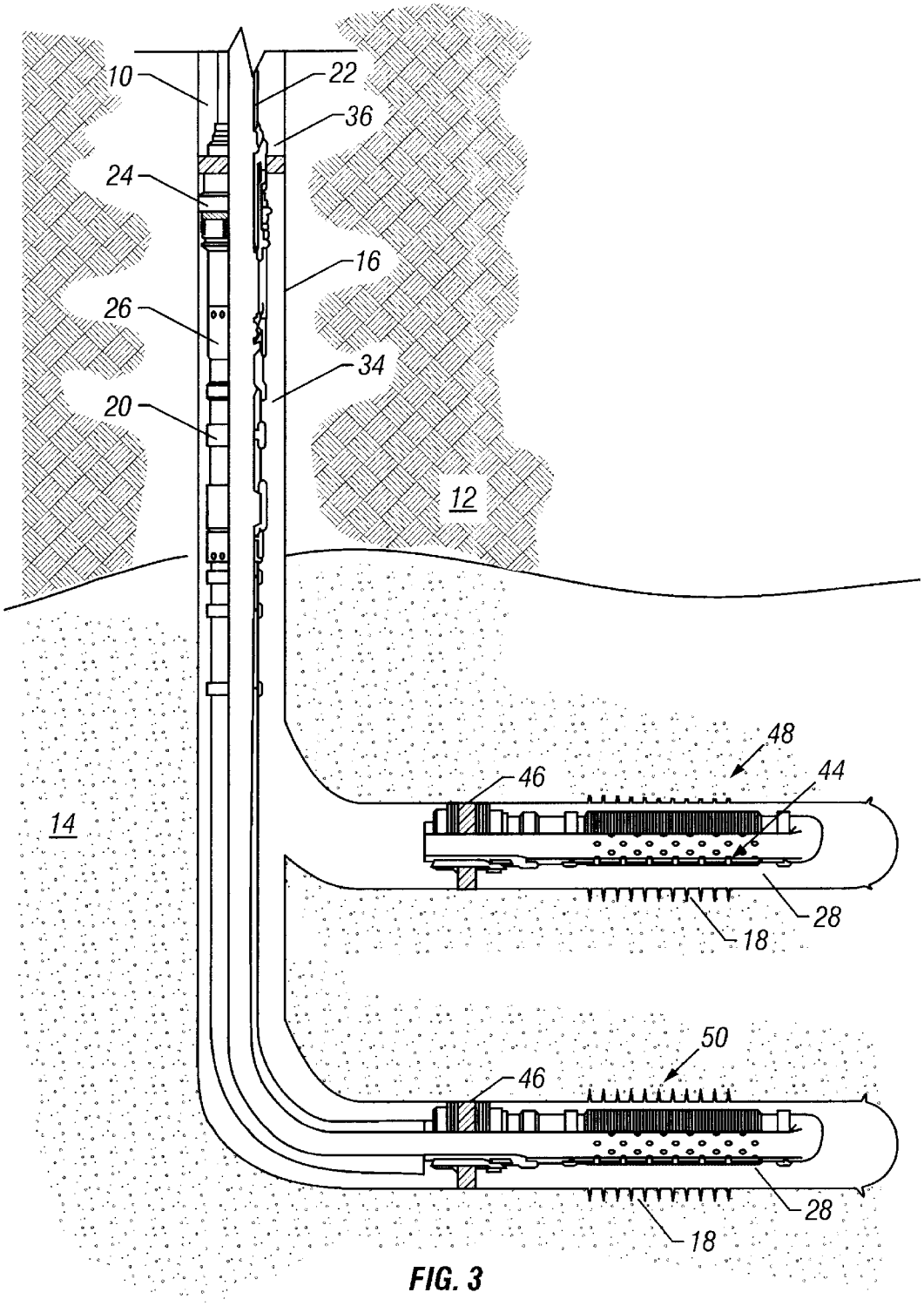
FIG. 3 illustrates an application of the present invention whereby one lateral wellbore is isolated while a different lateral wellbore is capable of being produced.

FIG. 3 illustrates one particular application of the present invention where two lateral wellbores are completed, an upper lateral 48 and a lower lateral 50. Both lateral wellbores are completed with a gravel pack operation comprising a lateral isolation packer 46 and a sand screen assembly 28. In this illustration, the upper lateral wellbore 48 is shown in an isolated configuration, this being accomplished by the setting of the isolation assembly 44 after the gravel pack operation. The lower lateral wellbore 50 is shown as completed and capable of being put into production without influence from the upper zone. The upper zone can be put into production by itself or in conjunction with the lower zone at a future date.

Figure 4:
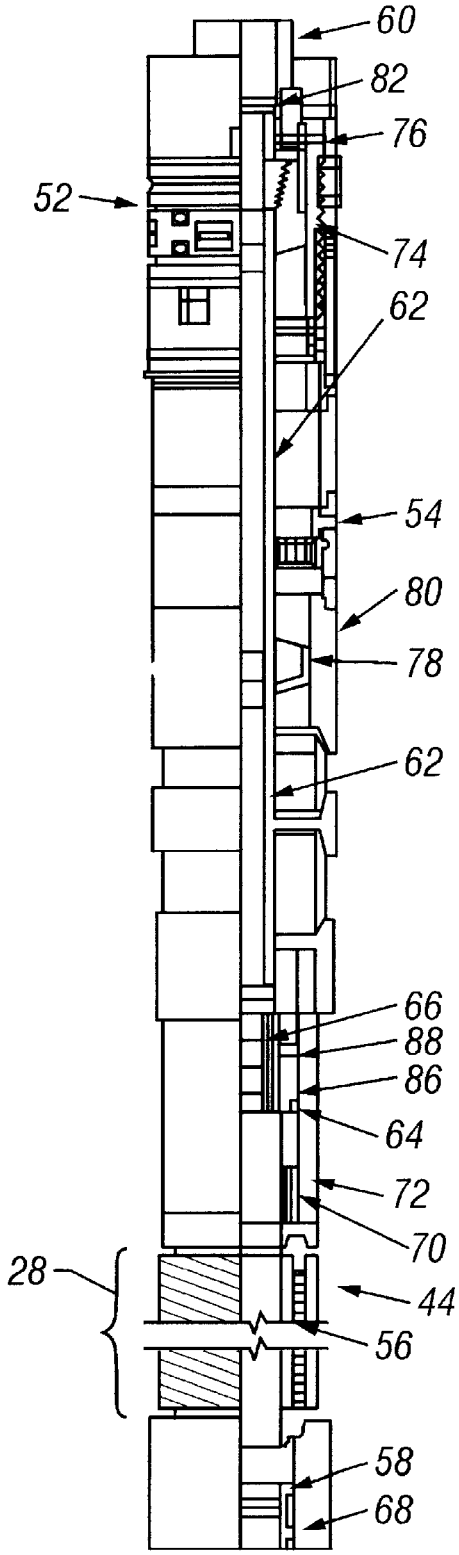
FIG. 4 is a section view of the overall zonal isolation system including an embodiment of the present invention.

FIG. 4 shows a cross section of an embodiment of the present invention. It includes a packer 52, cross-over ports 54, and a sand screen 28. A zonal isolation tubing string 56 is installed within the sand screen 28 using the polished bore/seal/collet method as described in U.S. Pat. No. 5,988,285. The zonal isolation tubing string 56 is installed with the lower isolation seals 58 disengaged, which allows fluid returns from the gravel pack operation to pass through the sand screen 28 and through the bottom of the zonal isolation tubing string 56. A shifting collet housing 64 is attached to the top of the zonal isolation tubing string 56. The shifting collet housing 64 comprises seal elements 86 that can engage in a polished bore receptacle or PBR 88 located within the housing 72. When the gravel pack operation is complete, the service tool 60 is withdrawn until the wash pipe 62 and shifting collet 66 exits the zonal isolation tubing string 56. The service tool 60 is then lowered to engage the shifting collet 66 with the shifting collet housing 64 and push the zonal isolation tubing string 56 down to engage the lower isolation seal 58 in the lower PBR 68. The seal elements 86 on the shifting collet housing 64 are engaged with the PBR 88 in the housing 72. When the zonal isolation tubing string 56 is in its lower position, it is retained by a latching collet 70 that engages with recesses in the housing 72. When the latching collet 70 is engaged in the lower position an upper seal 74 will be engaged in an upper packer PBR 76, and a lower seal 78 will be engaged in a lower packer PBR 80. These seals 74, 78 restrict any fluid communication between the inside of the zonal isolation tubing string 56 and the cross-over ports 54. A further downward force by the service tool 60 shifts the testing ports 82 to their open position so as to provide a hydraulic communication path between the inside of the zonal isolation tubing string 56, the wash pipe 62, and the tubing-wellbore annulus (not shown) above the packer 52. This hydraulic communication path is isolated from the sand screen 28 by the seal elements 58 and 86 and is isolated from the cross-over ports 54 by the seal elements 74 and 78. In this way the integrity of the zonal isolation tubing string 56 can be pressure tested independent of the other tool members.

Figure 5A:
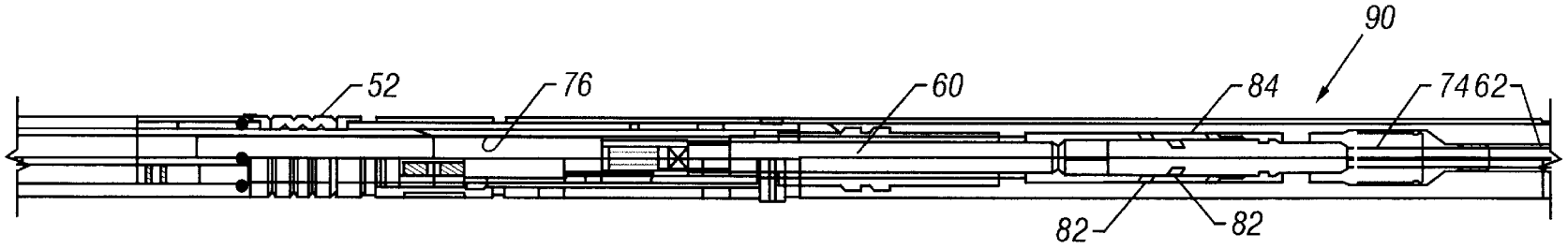
FIGS. 5A and 5B are illustrations of an embodiment of the present invention in its open and closed positions.

FIG. 5A is a partial view of an embodiment of the isolation string testing assembly 90. It includes a packer 52, service tool 60, wash pipe 62, upper seal 74, upper packer PBR 76, and the testing ports 82. This illustration shows the invention in the configuration just prior to the withdrawing of the service tool 60 and wash pipe 62 from the zonal isolation string (not shown) as described above. In this configuration the testing ports 82 are not aligned to each other and therefore are in a closed position. The testing ports 82 are held in the closed position by means of a retaining element 84 that is releasable. The retaining element 84 will typically comprise a shear element such as a shear pin or a shear screw that can be released (broken) with a force applied against it. Other retaining means, such as a retaining rings or clips, can also be utilized. From the configuration shown in FIG. 5A the service tool 60, upper seal 74 and wash pipe 62 are pulled upward (left in this illustration) whereby the service tool 60 and testing ports 82 are located above the packer 52. As shown in FIG. 4 and described above, when the service tool 60 and wash pipe 62 are withdrawn in this manner, the shifting collet 66 exits the zonal isolation tubing string 56. The service tool 60 and wash pipe 62 are then lowered (right in FIG. 5A) to engage the shifting collet 66 with the shifting collet housing 64 and push the zonal isolation tubing string 56 downward to engage the lower isolation seal 58 into the lower PBR 68, as shown in FIG. 4.

Referring again to FIG. 4, the zonal isolation tubing string 56 extends across the sand screen 28 and is sealed on the lower end by the lower isolation seal 58 in the lower PBR 68. The shifting collet housing 64 comprises seal elements 86 that engage in the PBR 88 located within the housing 72, which seals the zonal isolation tubing string 56 on the upper end. The sealed zonal isolation tubing string 56 restricts fluid flow through the sand screen 28. The upper seal 74 is engaged in the upper packer PBR 76, and the lower seal 78 is engaged in the lower packer PBR 80. The upper seal 74 and lower seal 78 act to isolate the cross-over ports 54. The testing ports 82 are shown in their aligned and therefore open configuration. In this configuration the interior of the sealed zonal isolation tubing string 56 is hydraulically connected through the wash pipe 62 and testing ports 82 to the annulus area between the service tool 60 and the wellbore above the packer 52.

The integrity of the zonal isolation tubing string 56 seal across the sand screen 28 can then be tested by imposing an elevated pressure onto the tubular-wellbore annulus at the surface. This elevated pressure will be communicated through the hydraulic path described above to the zonal isolation tubing string 56. If an adequate seal has been made between the zonal isolation tubing string 56 and the sand screen 28, the elevated pressure will not leak off through the sand screen 28 into the completed formation. The holding of the elevated annulus pressure at the surface will confirm that there is an adequate sealing off of the sand screen 28. After the integrity of the seal has been tested in the manner described above, the service tool 60, testing port 82 assembly, upper seal 74, wash pipe 62, lower seal 78, and shifting collet 66 can be removed from the well. The zonal isolation tubing string 56 will remain held in place by the latching collet 70 that is engaged in the recesses in the housing 72. In this manner the well is left with the completed zone isolated by the zonal isolation tubing string 56 across the sand screen 28 and by the packer 52 that seals off the annulus between the sand screen 28 assembly and the wellbore.

Figure 5B:
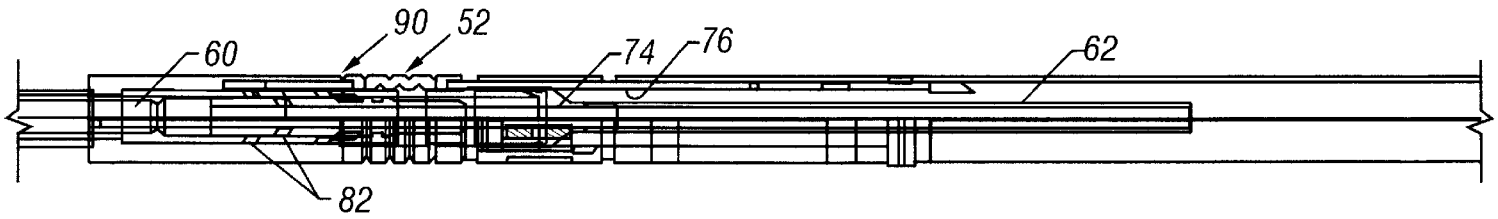

Referring to FIG. 5B, once the service tool 60 has been lowered as described above, the upper seal 74 becomes engaged in the upper packer polished bore receptacle 76. Further downward force applied to the service tool 60 will release the retaining element 84 and allow movement for the testing ports 82 to align and be in an open position as shown in FIG. 5B. Once the testing ports 82 are in their open position, they work in conjunction with the upper seal 74 and other sealing elements 58, 78 and 86 (shown in FIG. 4) to provide hydraulic communication between the zonal isolation tubing string 56 (shown in FIG. 4) and the tubing-wellbore annulus area (not shown) above the packer 52. In this configuration, the integrity of the entire isolation assembly 44 (shown in FIG. 3) can be tested by imposing hydraulic pressure upon the tubing-wellbore annulus at the surface.

The terms "tubing" and "workstring" as used in the present application are used in a general sense to describe the strings of pipe that can be used while working on a well. The terms are not meant to be exclusive and can include any number of differing designs and materials, for example, coiled tubing and fiberglass or plastic tubulars may be preferred in certain applications. Other terms are also known to those skilled in the art may also be used.

Figure 6A:
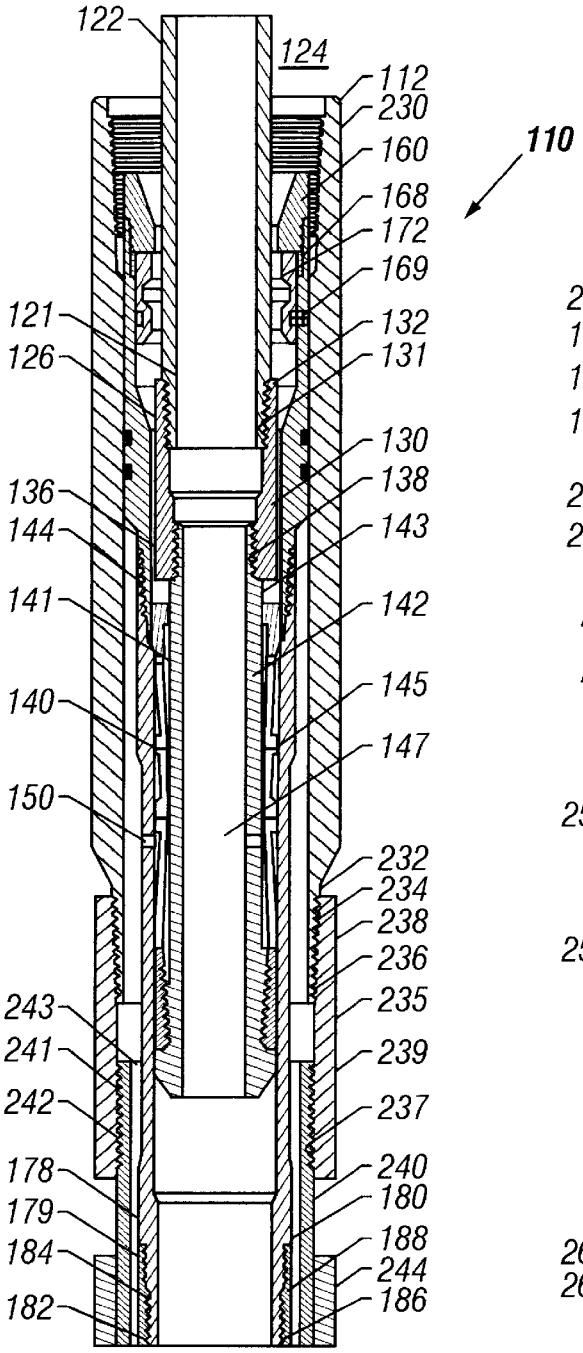
FIGS. 6A and 6B are elevational views in partial section of the zone isolation system wherein fluid is allowed to pass into the well bore.
Figure 6B:
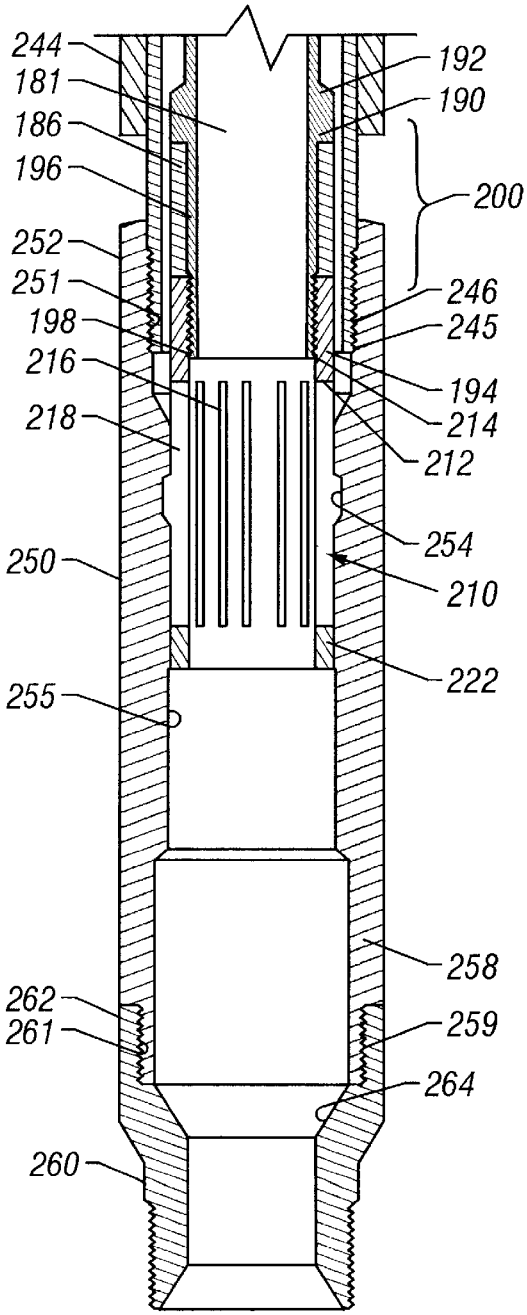

In FIGS. 6A and 6B, the zone isolation system 110 of the present invention is shown positioned within a production piping assembly 112. The production piping assembly 112 includes an upper polished bore receptacle or PBR 230 which is connected by external threads 234 at its distal end 232 to internal threads 236 in the proximal end 238 of a collar 235. The distal end 239 of the collar 235 is connected by internal threads 237 to external threads 241 located on the proximal end 242 of a blank pipe and screen assembly 240. The screen assembly 240 includes a sand control production screen 244. The blank pipe and screen assembly 240 is in turn threadably connected by external threads 245 on its distal end 246 to internal threads 251 on the proximal end 252 on a lower PBR 250. The distal end 258 of the lower PBR 250 is connected by external threads 259 to internal threads 261 located on the proximal end 262 of a bottom sub 260.

At the proximal end of the production piping assembly 112 is located a washpipe 122, a top sub 130 and a shifting collet assembly 140. The distal end 121 of the wash pipe 122 is connected by external threads 126 to internal threads 131 located on the proximal end 132 of the top sub 130. The distal end 136 of the top sub 130 is connected by internal threads 138 to external threads 144 formed on the proximal end 143 of a mandrel 142. The mandrel 142 carries the shifting collet 145 on its exterior surface 141. If desired, holes or slots 150 (shown only in FIG. 6) may be formed through the mandrel 142 to prevent the buildup of sand in the space between the bottom of the flexible beam portions 151 (FIG. 7) and the exterior surface 141 of the mandrel 142.

Figure 7:
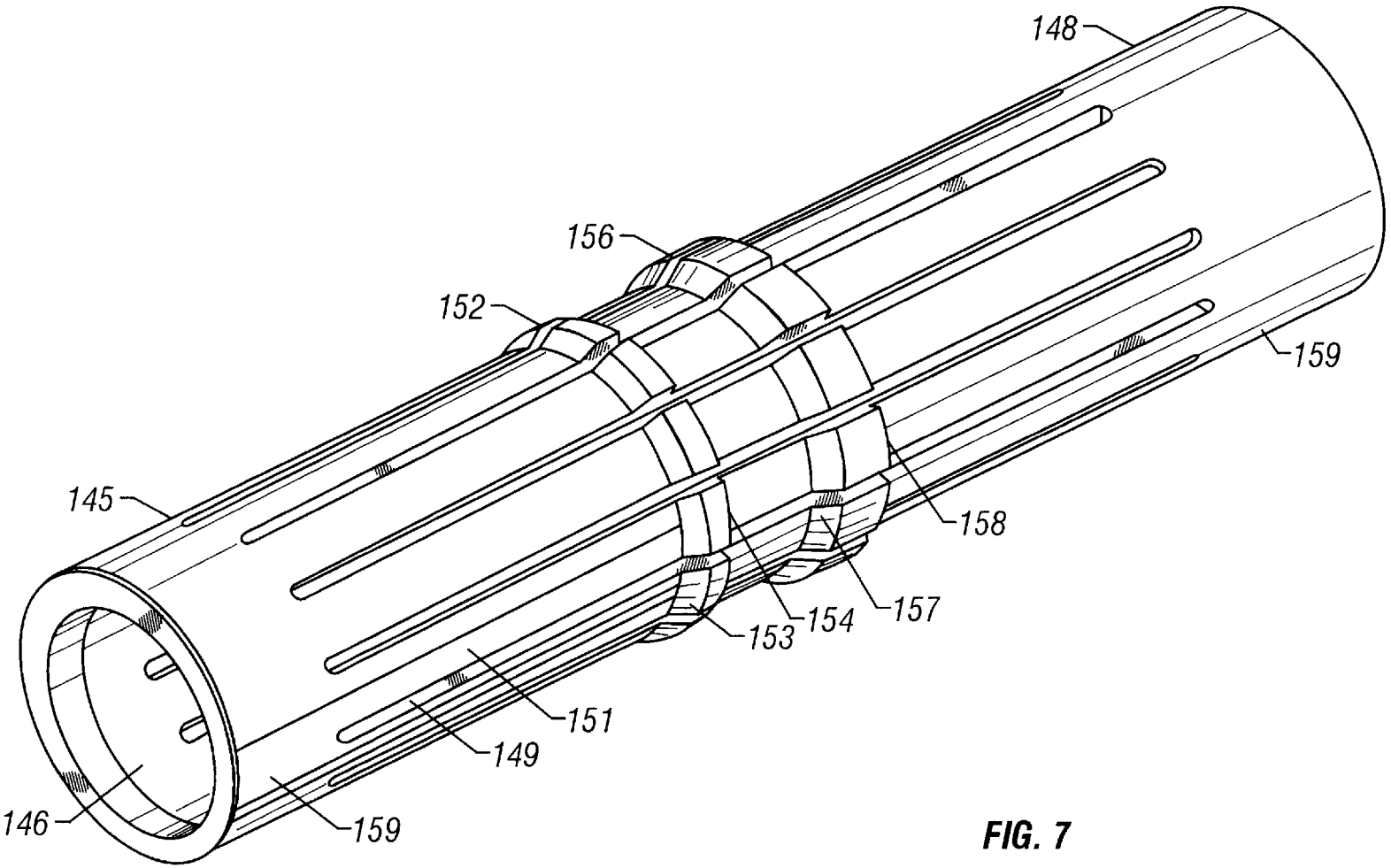
FIG. 7 is a perspective view of the shifting collet.

The shifting collet 145 itself is shown in FIG. 7. It includes an interior bore 146 for housing the mandrel 142. Formed on the exterior surface 148 are a plurality of proximal projections 152 and a plurality of distal projections 156. The proximal projections 152 includes a ramp 153 and a shoulder 154. Similarly, the distal projections 156 include a ramp 157 and a shoulder 158. Slots 149 are formed in the shifting collet 145 so that the projections 152 and 156 are effectively located on a flexible beam 151 anchored at the solid portions 159 at either end of the shifting collet 145. The utilization of the flexible beam 151 portion of the shifting collet 145 will be explained below.

Figure 8:
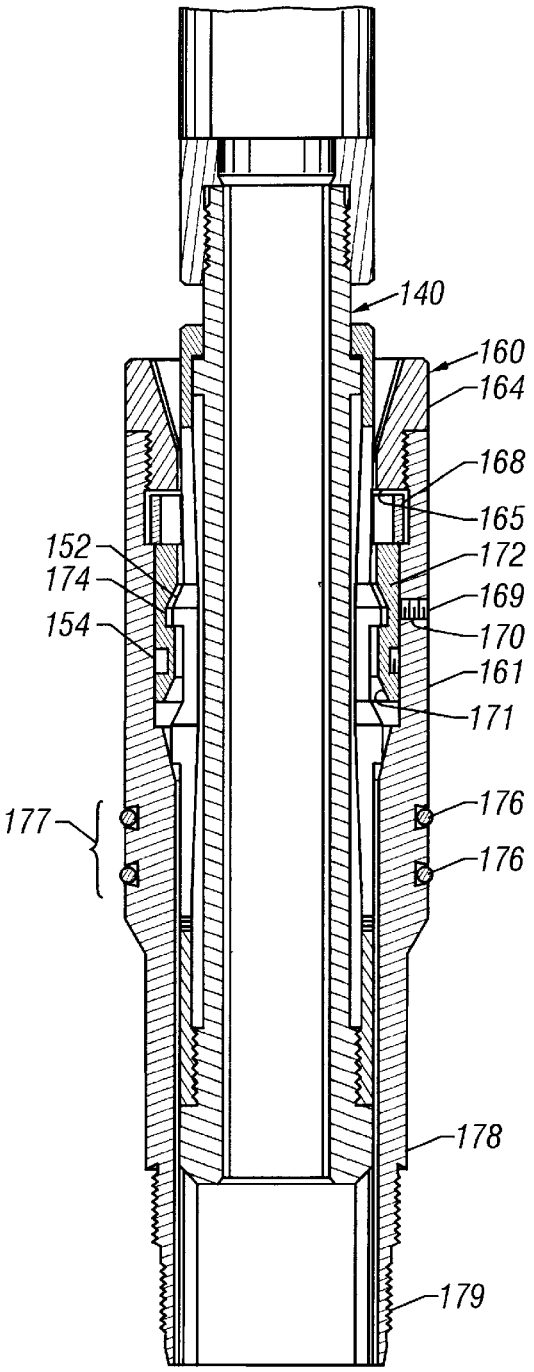
FIG. 8 is an elevational view in partial section of the initial movement of the shifting collet assembly through the shifting collet housing assembly.
Figure 9:
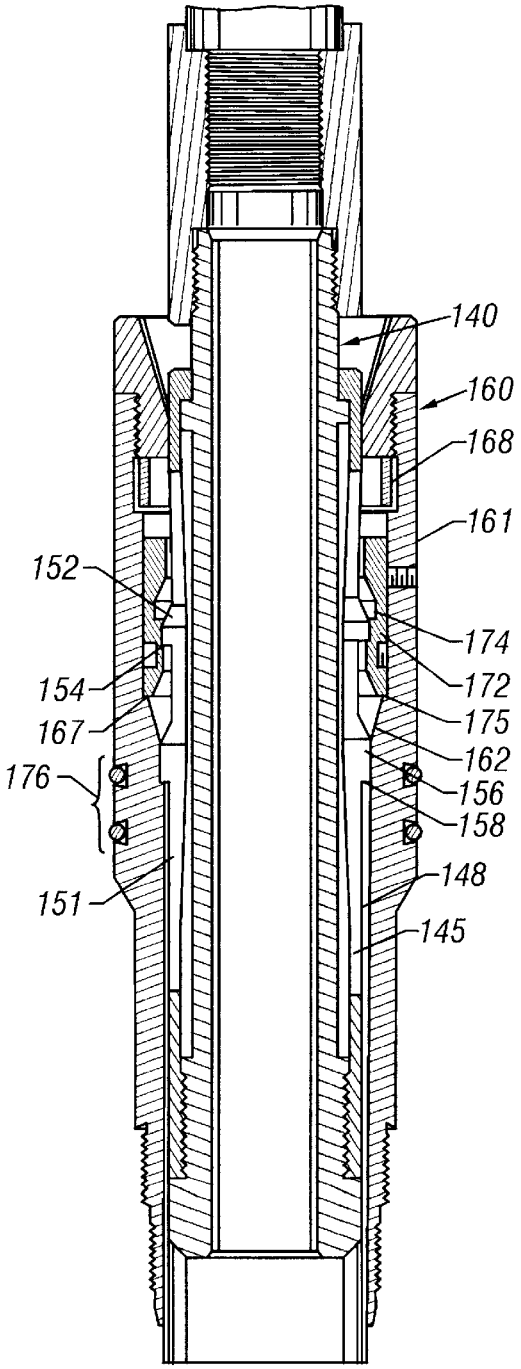
FIG. 9 is an elevational view in partial section of the further movement of the shifting collet assembly through the shifting collet housing assembly.

As shown by reference to FIG. 8 and to FIG. 9, the shifting collet assembly 140 is sized to fit within a shifting collet housing assembly 160. Located on the exterior 161 of the shifting collet housing assembly 160 are a pair of O-rings 176 which form a proximal fluid seal assembly 177 against the interior 231 (FIG. 10) of the upper PBR 230. Alternatively, bonded seals as explained below in the description of the lower collet assembly 210 may be used.

By reference back to FIGS. 6A and 6B, it may be seen that the distal end 178 of the shifting collet housing assembly 160 is threadably connected to the internal threads 184 formed on the proximal end 182 of the isolation pipe string assembly 180. The external threads 188 on the distal end 186 of the isolation pipe string assembly 180 are threadably connected to the internal threads 194 formed on the proximal end 192 of a seal sub 190. Surrounding the seal sub 190 at its distal end 196 is a distal seal 200 which forms a fluid seal against the interior surface 255 of the lower PBR 250.

Connected to the external threads 198 formed on the distal end 196 of the seal sub 190 are the internal threads 214 formed on the proximal end 212 of a lower collet assembly 210. The lower collet assembly 210 includes slots 216 through which fluids passing through the sand control production screen 244 may flow.

By further reference to FIGS. 6A and 6B, the flow path for fluids will be through the sand control production screen 244, thence through the annulus 243 between the blank pipe and production screen assembly 240 and the isolation pipe string assembly 180, past the distal seal 200 and through the slots 216 in the lower collet assembly 210 and then upward through the interior bore 181 of the isolation pipe string assembly 180, through the interior bore 147 of the mandrel 142, through the top sub 130 and finally through the wash pipe 122. Travel of fluid through the annulus 243 between the isolation pipe string assembly 180 and the blank pipe and screen assembly 240 is prevented by the proximal fluid seal 177 (FIG. 8) between the shifting collet housing assembly 160 and the upper PBR 230.

Figure 10A:
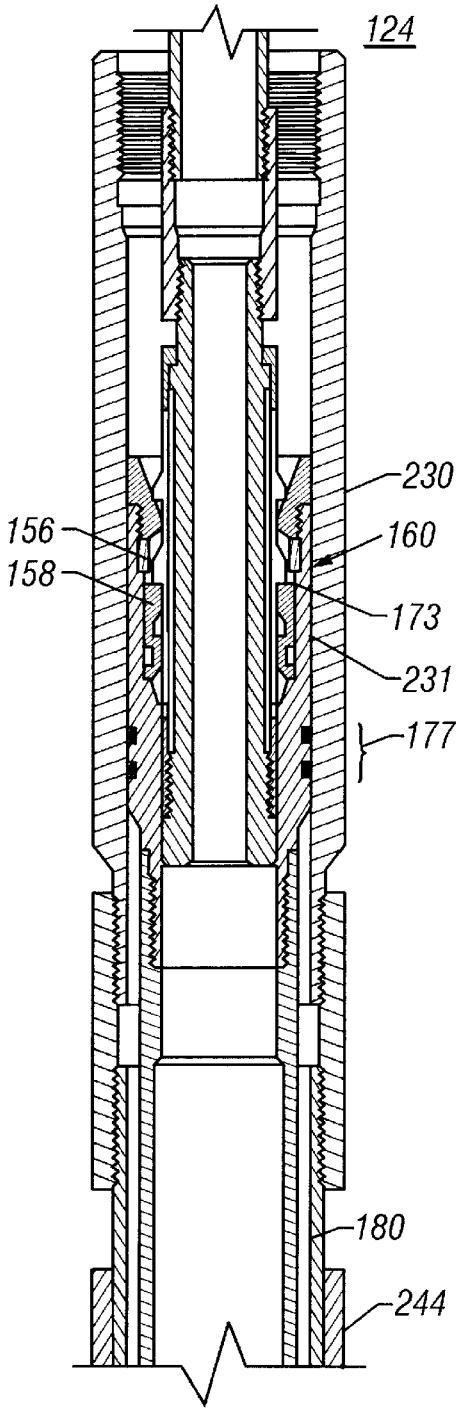
FIGS. 10A and 10B are an elevational view in partial section of the zone isolation system in a second position wherein the fluid flow through the sand control production screen is prevented from flowing back into the well bore.
Figure 10B:
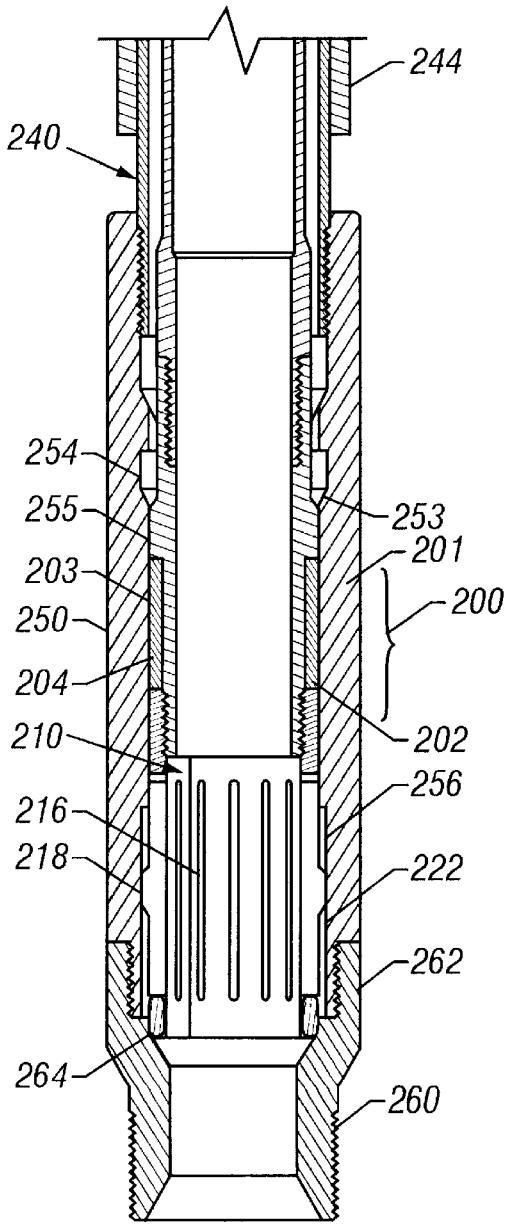

When it is desired to prevent the flow of fluid through the interior 181 of the isolation pipe string assembly 180 it is necessary to move the isolation pipe string assembly 180 into a lower or more distal position within the well bore 124. As may be seen in FIGS. 10A and 10B, this lower or more distal position maintains the barrier to fluid flow formed by the proximal fluid seal 177 between the shifting collet housing assembly 160 and the inner bore 231 of the upper PBR 230. The distal seal 200 established by sealing contact between the seal assembly 200 and the inner bore 255 of the lower PBR 250 prevents fluid flow through the lower collet assembly 210. This distal seal 200 is established by a pair of bonded seals 201 and 202 including O-ring seals 203 and 204 on their interior surfaces. To recap, and as shown in FIGS. 10A and 10B as fluid passes through screen 244 it is blocked from traveling upward through the well bore 124 by the proximal fluid seal assembly 177 formed against the interior bore 231 of the upper PBR 230 and it is blocked from traveling through the slots 216 in the lower collet assembly 210 by the distal fluid seal assembly 200 formed against the interior wall 255 of the lower PBR 250.

The movement of the isolation pipe string assembly 180 to its second or more distal position within the well bore 124 is a two stroke operation as shown in FIGS. 8, 9 and 10A–10B. First, the shifting collet assembly 140 is pulled upwardly through the isolation pipe string assembly 180 and through the shifting collet housing assembly 160. Such withdrawal of the shifting collet assembly 140 through the shifting collet housing assembly 160 causes the ramps 153 and 157 on the proximal and distal projections 156 emanating from the side 148 of the shifting collet 145 (FIG. 7) to slide past the ramp 171 formed on the bottom of the sliding release sleeve 172 and past the ramp 165 formed on the bottom of the entry guide 164.

Once the shifting collet assembly 140 has been pulled through the shifting collet housing assembly 160, it is reinserted into the shifting collet housing assembly as shown in FIG. 8. It is at this time that any repairs or adjustments to the service tool, the production pipeline or any of the packing assemblies may be made. This reinsertion of the shifting collet assembly 140 into the shifting collet housing assembly 160 causes the proximal projections 152 on the exterior surface 148 of the shifting collet 145 to enter the recess 174 in the center portion of the sliding release sleeve 172. The shoulders 154 on the bottom of the proximal projections 152 push against the bottom of the recess 174 and severs the shear screw 169 which, by threadable engagement with hole 170 has held the sliding release sleeve 172 in a proximal position with respect to the shifting collet housing assembly 160 as shown in FIG. 6A.

The movement of the sliding release sleeve 172 after the shear screw 169 has been severed, as shown in FIG. 8, accomplishes two things. First, the snap ring 168 collapses inward as it no longer is held in its distended position by the proximal location of the sliding release sleeve 172 (FIG. 6A). The collapsed position of the snap ring 168 prevents upward movement of the sliding release sleeve 172 back through the shifting collet housing assembly 160. Second, as shown in FIG. 9, the bottom shoulder 175 of the sliding release sleeve 172 engages a shoulder 167 formed within the shifting collet housing assembly 160. The shifting collet 145 continues to pass through the shifting collet housing assembly 160. The shoulders 158 on the distal projections 156 of the exterior surface 148 of the shifting collet 145 ride down ramp 162. This movement causes a downward movement of the flex beam 151 portion of the shifting collet 145 which draws the proximal projections 152 out of the recess 174 formed in the sliding release sleeve 172. Further travel of the shifting collet assembly 140 through the shifting collet housing assembly 160 will cause the shoulders 154 on the proximal projections 156 to move along ramp 162.

Once the shifting collet assembly 140 has passed through the shifting collet housing assembly 160 a first time, the shifting collet assembly 140 is withdrawn back through the shifting collet housing assembly 160. The shifting collet assembly 140 is now caused to enter the shifting collet housing assembly 160 a second time. This re-entry of the shifting collet assembly 140 into the shifting collet housing assembly 160 is shown in FIGS. 10A and 10B. The shoulder 158 on the bottom of the distal projection 156 engages the shoulder 173 on top of the sliding release sleeve 172. Continued downward force by the shoulder 158 on the distal projection 156 against the shoulder 173 on top of the sliding release sleeve 172 will cause the entire isolation pipe string assembly 180 to move to the distal end of the well bore 124.

As may be seen by comparing FIGS. 6A–6B to FIGS. 10A–10B, the downward movement of the isolation pipe string assembly 180 within the well bore 124 can only be accomplished if the projection 218 on the exterior of the lower collet assembly 210 is moved out of engagement with proximal recess 254 formed within lower PBR 250. Such movement will allow the distal seal assembly 200 to move from within the blank pipe and screen assembly 240 to a position wherein sealing contact is formed against the interior wall 255 of the lower PBR 250. Once the isolation pipe string assembly 180 is moved by the force of shoulder 158 against shoulder 173 the projection 218 will move inward to slide along the interior 255 of the lower PBR 250 and then move outward to enter the distal recess 256 formed on the distal end 258 of the lower PBR 250. The distal end 222 of the lower collet assembly 210 will come to rest against a slant shoulder 264 formed within the bore of the proximal end 262 of the bottom sub 260.

Figure 11A:
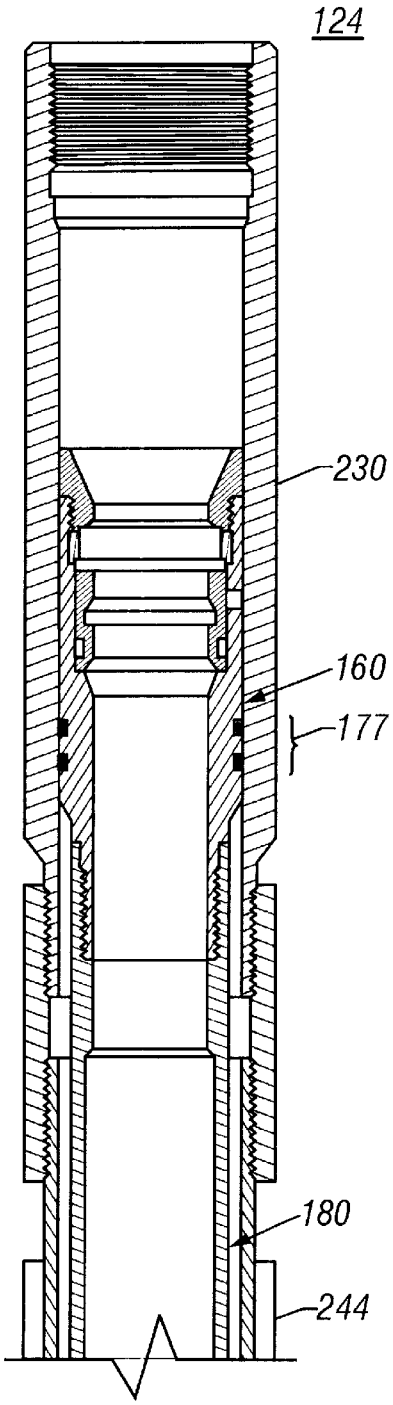
FIGS. 11A and 11B are elevational views in partial section of the zone isolation system with the shifting collet assembly removed.
Figure 11B:
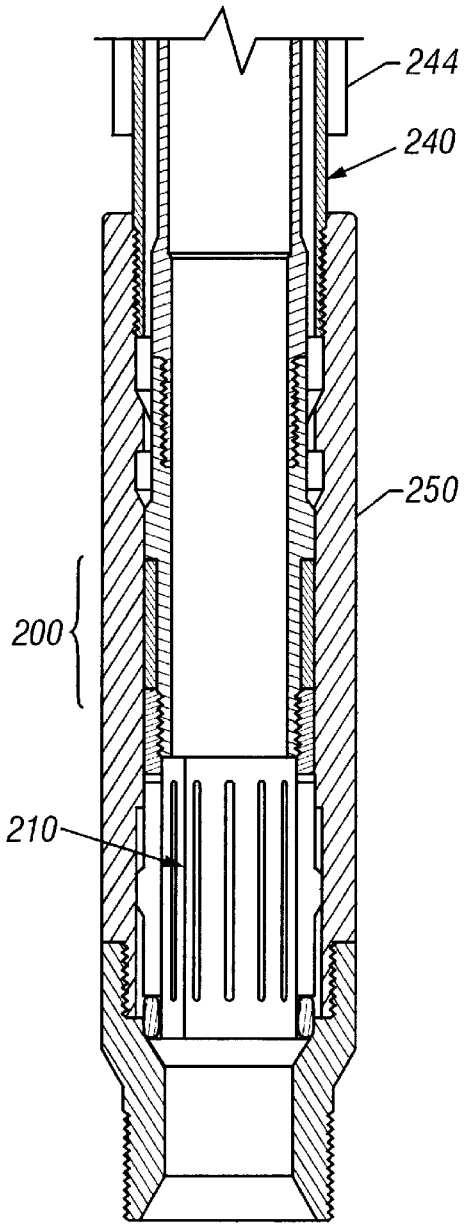

By reference to FIGS. 11A–11B, there is nothing to retain the shifting collet assembly 140 within the shifting collet housing assembly 160, thus it may be easily removed as previously described. Passage of fluids from the formation surrounding the well bore 124 is accomplished by perforating the isolation pipe string assembly 180 or alternatively moving a sliding sleeve (not shown) which covers an opening formed in the isolation pipe string assembly 180.

The following description of the assembly and operation of the zone isolation system refer to numbered components found in FIGS. 6A–11B.

The zone isolation system 110 is assembled by threadably connecting the lower PBR 250 to the blank pipe and screen assembly 240. Next, the lower collet assembly 210 is threadably connected to the seal sub 190 which includes the distal seal assembly 200.

Next the lower collet assembly 210 is inserted into the lower PBR 250 so that the projection 218 on the exterior of the lower collet assembly 210 engages the proximal recess 254 after sliding along the entry ramp 253 (FIG. 10B) formed on the proximal end 252 of the lower PBR 250. The shifting collet assembly 140 is then slid through the shifting collet housing assembly 160 so that the proximal projections 152 and the distal projections 156 on the exterior 148 of the shifting collet assembly 140 enters the interior bore 181 of the isolation pipe string assembly 180. The shifting collet housing assembly 160 is then attached to the top of the isolation pipe assembly 180. The wash pipe 122 is then threadably attached to the top sub 130. Finally, the upper PBR 230 is threadably attached to the blank pipe end screen assembly 240.

When it is desired to activate the zone isolation system 110 to move the isolation pipe string assembly 180 further into the well bore 124 a service tool (not shown) is connected to the wash pipe 122 to pull the shifting collet assembly 140 out of the shifting collet housing assembly 160 so that the bottom of the shifting collet assembly 140 clears the top of the shifting collet housing assembly 160.

The next step is to apply a set-down weight on the shifting collet assembly 140. Because the distal projection 156 on the exterior of the shifting collet 145 is larger than the proximal projection 152, it slides past the recess 174 in the sliding release sleeve 172. When the proximal projections 152, which are sized to enter the recess 174 in the sliding release sleeve, the beam 151 flexes outward. This outward flexing of the beam 151 causes the shoulders 154 on the proximal projections 152 on the shifting collet assembly 145 to engage the bottom of the recess 174 in the sliding release sleeve 172. As previously indicated this causes the shear screw 169 to sever and the sliding release sleeve 172 to move downward into contact with a shoulder 167 within the shifting collet housing assembly 160. The snap ring 168 is now free to move inward to block the upward travel of the shifting release sleeve 172. The inward flexing of the beam portions 151 of the shifting collet 145 cause the proximal projections 152 to move out of the recess 173. This completes the first entry of the shifting collet assembly 140 into the shifting collet housing assembly 160.

The closing off the sand control production screen 244 from the flow of fluid is accomplished by moving the distal seal 200 into contact with the interior surface 255 of the lower PBR 250. This movement is accomplished by a second insertion of the shifting collet assembly 140 into the shifting collet housing assembly 160. The shoulders 158 on the distal projections 156 engage the top of the sliding release sleeve 172 which causes the bottom of the sliding release sleeve 172 to push against a shoulder 167 formed within the shifting collet housing assembly 160. The area of surface engagement is sufficient to apply enough force on the shifting collet housing assembly 160 to move the projections 218 on the lower collet assembly 210 inward so that they may travel along the inner bore 255 of the lower PBR 250 before moving outward into recess 256. Because there are no threadable connections between the shifting collet assembly 140 and the shifting collet housing assembly 160, the shifting collet assembly 140 may be easily withdrawn back through the shifting collet housing assembly 160. The isolation pipe string assembly 180 is now in place behind the sand control production screen 244 with the proximal seal 177 blocking the upward passage of fluid and the distal seal 200 blocking the downward passage of fluid.

Some of the discussion and illustrations within this application refer to a vertical wellbore that has casing cemented in place and comprises casing perforations to enable communication between the wellbore and the productive formation. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A zone isolation apparatus for use in completing a wellbore comprising:

a sand screen assembly disposed within the wellbore and comprising a packer element;

a tubular string disposed within the wellbore defining an annulus area therebetween;

an isolation assembly movable within the sand screen assembly and capable of being selectively positioned in an open configuration and a closed configuration; and a test assembly attached to the tubular string and capable of being selectively positioned in an open configuration and a closed configuration, whereby when the isolation assembly is in its closed configuration, fluid communication through the sand screen assembly is restricted, whereby when the test assembly is in its open configuration, hydraulic communication of the isolation assembly with the surface is achieved, wherein when the isolation assembly is in its closed configuration and the test assembly is in its open configuration, hydraulic communication between the annulus area above the packer and the interior of the isolation assembly is achieved, while providing hydraulic isolation from the annulus area below the packer.

2. The apparatus of claim 1, wherein the test assembly is retained in the closed configuration by a releasable retaining element.

3. The apparatus of claim 2, wherein the test assembly further comprises a sliding sleeve having at least one aperture therethrough and a stationary sleeve having at least one aperture therethrough.

4. The apparatus of claim 3, wherein when the test assembly is in its open configuration the at least one aperture of the sliding sleeve is aligned with the at least one aperture of the stationary sleeve and fluid communication is provided through the aligned apertures.

5. The apparatus of claim 1, wherein the isolation assembly comprises an isolation pipe and at least one seal element.

6. The apparatus of claim 5, wherein when the isolation assembly is in its closed configuration, the isolation pipe forms a seal within the sand screen assembly and fluid communication through the sand screen assembly is restricted.

7. The apparatus of claim 6, wherein the isolation assembly comprises a shifting collet assembly attached to the tubular member that is capable of engaging with the isolation pipe.

8. The apparatus of claim 7, wherein the shifting collet assembly comprises a plurality of flex beam portions that are capable of engaging with the isolation pipe.

9. The apparatus of claim 7, wherein the isolation pipe comprises a latching collet assembly that engages with the sand screen assembly when the isolation assembly is in its closed configuration.

10. The apparatus of claim 6, wherein the test assembly comprises a test port and at least one seal assembly.

11. The apparatus of claim 10, wherein the test port and the at least one seal assembly is capable of aligning with the packer and the sand screen assembly to provide hydraulic communication of the interior of the isolation assembly with the annulus area above the packer and hydraulic isolation from the annulus below the packer.

12. A tool for isolating and testing a sand screen assembly within a wellbore comprising:

a tubing string disposed within the wellbore and forming a tubing-wellbore annulus;

an isolation pipe assembly movable within the sand screen assembly and capable of being selectively positioned in an upper position and a lower position;

an isolation test tool attached to the tubing string and capable of being selectively positioned in an open configuration and a closed configuration;

whereby when the isolation pipe assembly is in its lower position, fluid communication through the sand screen assembly is restricted; and whereby when the isolation test tool is in its open configuration, hydraulic communication between the interior of the isolation pipe assembly and the tubing-wellbore annulus above the isolation test tool is achieved.

13. The tool of claim 12, wherein the sand screen assembly further comprises a packer element.

14. The tool of claim 12, wherein the isolation test tool comprises a sliding sleeve having at least one test port therethrough.

15. The tool of claim 12, wherein the isolation pipe assembly is retained in its upper position by a releasable retaining element.

16. The tool of claim 15, wherein the isolation pipe assembly is capable of shifting from its upper position to its lower position by means of a shifting collet connection with the tubing string.

17. The tool of claim 16, wherein the isolation test tool is held in its closed configuration by a retaining element.

18. A method for isolating and testing a sand screen assembly in a wellbore from passage of fluids therethrough comprising:

positioning an isolation pipe assembly within the sand screen assembly;

positioning an isolation test tool attached to a tubing string within the wellbore;

shifting the isolation pipe assembly into a sealed position wherein the isolation pipe assembly is in sealing contact with the sand screen assembly, thereby restricting fluid flow through the sand screen assembly;

shifting the isolation test tool to a testing configuration; and testing the integrity of the seal between the isolation pipe assembly and the sand screen assembly, wherein the shifting of the isolation test tool to a testing configuration comprises aligning testing ports to an open position to create hydraulic communication between the interior of the isolation pipe assembly and an annulus region in the wellbore.

19. The method of claim 18, wherein the isolation pipe assembly comprises a sliding sleeve mechanism in sliding contact with the sand screen assembly.

20. The method of claim 18, wherein the shifting of the isolation pipe assembly utilizes a shifting collet connected to the tubular string.

21. The method of claim 20, wherein the shifting of the isolation pipe assembly comprises the imposition of a downward force on the tubular string that is transferred through the shifting collet connection onto the isolation pipe assembly.

22. The method of claim 21, wherein once the isolation pipe assembly is shifted into its sealed position, the isolation pipe assembly is retained in its sealed position by means of a retaining collet.

23. The method of claim 22, wherein the shifting of the isolation test tool comprises further downward force on the tubular string that is transferred onto the isolation pipe assembly.

24. The method of claim 23, wherein the isolation pipe assembly and the isolation test tool are held in their initial position by retaining elements.

25. The method of claim 24, wherein the retaining elements comprise shear elements.

26. The method of claim 18, wherein the testing of the integrity of the seal between the isolation pipe assembly and the sand screen assembly comprises pressure testing of an annulus region in the wellbore that is in hydraulic communication with the interior of the isolation pipe assembly.

27. The method of claim 18, wherein the shifting of the isolation pipe assembly further comprises aligning at least one seal that isolates a cross-over port located within the sand screen assembly from hydraulic communication with the isolation pipe assembly.

28. An isolated production pipe assembly formed according to a method comprising:

providing a non-isolated production pipe assembly in a wellbore, the non-isolated production pipe having a sand control screen;

attaching a shifting collet housing assembly to an isolation pipe string assembly;

inserting the shifting collet housing assembly and isolation pipe string assembly into the non-isolated production pipe assembly;

attaching a testing tool capable of being in a first configuration and a second configuration, a shifting collet assembly and a tubular string to form a work string;

inserting the work string into the wellbore, thereby defining a work string-wellbore annulus, so that the shifting collet assembly engages the interior of the shifting collet housing assembly;

imparting a downward force on the work string to move the isolation pipe string assembly into a position wherein the isolation pipe string assembly is in sealing contact with the non-isolated production pipe assembly both above and below the sand control production screen, thereby converting the non-isolated production pipe assembly into an isolated production pipe assembly, wherein the isolated production pipe assembly in the wellbore prevents fluid flow through the sand control screen;

imparting a further downward force on the work string to shift the testing tool from its first position to its second position, so that the testing tool provides hydraulic communication between the interior of the isolated production pipe assembly and the work string-wellbore annulus above the testing tool; and pressure testing the work string-wellbore annulus to test the integrity of the isolated production pipe assembly.

29. The method of claim 28, wherein the isolation pipe string assembly is retained in sealing contact with the non-isolated production pipe by means of a retaining collet device.

30. The method of claim 29, wherein the testing tool is held in its first position by means of a retaining element.

31. The method of claim 30, wherein the retaining element comprises a shear element that will break when a predetermined force is applied against it.

32. A method of gravel packing, isolating and testing a sand screen completion of a wellbore in a single trip comprising:

inserting into the wellbore a sand screen assembly, an isolation pipe, and a test assembly on a workstring;

performing a gravel pack operation;

shifting the isolation pipe to a position in sealing contact with the sand screen assembly, thereby isolating the sand screen assembly;

shifting the test assembly to a configuration that provides hydraulic communication between the interior of the isolation pipe and the workstring-wellbore annulus above the test assembly; and hydraulically testing the integrity of the seal between the isolation pipe and the sand screen assembly by imposing pressure on the workstring-wellbore annulus.

33. The method of claim 32, wherein the sand screen assembly includes a packer located above the sand screen.

34. The method of claim 33, wherein the test assembly comprises a test port and at least one seal assembly.

35. The method of claim 34, wherein when the workstring is used to shift the test assembly, the test port and the at least one seal assembly align with the packer and the sand screen assembly to provide hydraulic communication between the interior of the isolation pipe and the workstring-wellbore annulus above the packer while providing hydraulic isolation from the sand screen assembly-wellbore annulus area below the packer.

36. The method of claim 32, wherein during the gravel pack operation carrier fluid returns are able to circulate to the surface through the sand screen, isolation pipe, test assembly, and workstring.

37. A method of completing a well comprising:

isolating a sand screen assembly with isolation tubing; and pressurizing a workstring-wellbore annulus to test a hydraulic seal of the isolated sand screen assembly through a test assembly.

38. The method of claim 37, further comprising:

inserting the sand screen assembly, the isolation tubing and the test assembly into the well on a workstring;

shifting the isolation tubing into a sealed position within the sand screen assembly; and shifting the test assembly into an open position.

39. The method of claim 38, wherein a gravel pack operation is performed prior to isolating the sand screen assembly.

40. The method of claim 39, wherein the well is flow tested prior to isolating the sand screen assembly.

41. A method of isolating a producing formation within a well drilled from the surface, comprising:

isolating a sand screen assembly;

isolating a cross-over port;

providing communication between the inside of the isolated sand screen assembly and the surface;

applying pressure to the interior of the isolated sand screen assembly; and testing the hydraulic seal within the sand screen assembly.

42. The method of claim 41, further comprising:

providing hydraulic isolation of the interior of the isolated sand screen assembly from the producing formation.

43. The method of claim 41, wherein communication between the interior of the isolated sand screen assembly and the surface is achieved by opening at least one test port.

44. A method of isolating a producing formation within a well drilled from the surface, comprising:

isolating a sand screen assembly;

isolating a cross-over port;

providing communication between the inside of the isolated sand screen assembly and the surface;

applying pressure to the interior of the isolated sand screen assembly; and testing the hydraulic seal within the sand screen assembly;

wherein all of the above steps are performed in a single trip into the well.

45. The method of claim 44, further comprising:

providing hydraulic isolation of the interior of the isolated sand screen assembly from the producing formation.

46. The method of claim 45, wherein communication between the interior of the isolated sand screen assembly and the surface is achieved by opening at least one test port.

* * * * *